US005086544A

United States Patent [19]

Huttemann et al.

[11] Patent Number: 5,086,544

[45] Date of Patent: Feb. 11, 1992

[54] CUTLERY BASKET FOR DISH-WASHING MACHINE

[75] Inventors: Wilfred Huttemann; Hettenhausen, Ulrich, both of Bielefeld; Horst Moller, Werther, all of Fed. Rep. of Germany

[73] Assignee: Miele & Cie, GmbH & Co., D-4830 Gutersloh 1, Fed. Rep. of Germany

[21] Appl. No.: 347,805

[22] Filed: Feb. 27, 1989

[30] Foreign Application Priority Data

Jul. 1, 1987 [DE] Fed. Rep. of Germany ..... 3721689

[51] Int. Cl.[5] ..... A47L 15/50

[52] U.S. Cl. ..... 211/41; 211/181

[58] Field of Search ..... 211/41, 40, 181, 70.7, 211/60.1

[56] References Cited

U.S. PATENT DOCUMENTS

| | | | |
|---|---|---|---|
| 115,344 | 5/1871 | Neefus | 211/41 |
| 378,369 | 2/1888 | Hyer | 211/41 X |
| 508,885 | 11/1893 | Johnston | 211/41 X |
| 1,019,212 | 3/1912 | Yates | 211/41 X |
| 1,187,711 | 6/1916 | Clark | 211/41 |
| 1,412,592 | 4/1922 | Allsop et al. | 211/41 X |
| 1,452,418 | 4/1923 | Cunneen | 211/41 |
| 1,562,614 | 11/1925 | Blakeslee | 211/41 |

*Primary Examiner*—Carl D. Friedman
*Assistant Examiner*—Derek J. Berger
*Attorney, Agent, or Firm*—Collard, Roe & Galgano

[57] ABSTRACT

In a cutlery-holding basket (5) for a dish-washing machine (1), in which the items of cutlery (6) which are to be washed and dried can be individually laid down lengthwise alongside one another in separate cutlery holders (9*a*) and cutlery supports (9*b*), the cutlery supports (9*b*) are constructed with differently profiled support surfaces (11) and/or different support heights. Because of this measure, it is equally possible for any arbitrary collection of items of cutlery (6) from various different sets of cutlery to be cleaned and dried in an optimal fashion.

5 Claims, 1 Drawing Sheet

CUTLERY BASKET FOR DISH-WASHING MACHINE

DESCRIPTION

Figure 1:
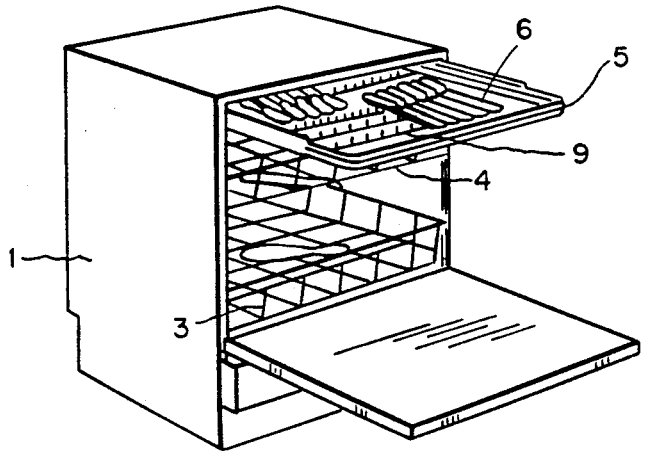

The object of the present invention relates to a cutlery-holding basket for a dish-washing machine, in which the items of cutlery which are to be washed and dried can be individually laid down lengthwise alongside one another in holders at small distances apart, where the holders are constructed to hold separate items of cutlery as well as providing supports with appropriate bearing surfaces for the items of cutlery.

A cutlery-holding basket of this type is already known from the German Offenlegungsschrift DE-OS 34 47 302.

In the case of the known cutlery-holding basket, the distances between the cutlery holders which are arranged in parallel in the basket are selected in such a manner that both small and large items of cutlery of different sets of cutlery can be placed in the basket to occupy as small a space as possible while allowing for ease of inspection, which means that a good cleansing and drying result can be achieved.

The droplets of water are conducted away from the items of cutlery so that there is no great accumulation of water droplets at any location. The bearing and support surfaces of the cutlery-holding basket which come into contact with the items of cutlery are configured and profiled in a such a manner that the areas of contact are as small as possible. The cutlery supports are therefore designed either as displaceable or statically arranged strips with wave-shaped or saw-tooth-shaped support surfaces for the items of cutlery and all of the strips are of the same height to receive the items of cutlery to be placed on them.

Under certain circumstances, with the use of known cutlery-holding baskets, in the sorting of larger items of cutlery in particular, such as knives or large spoons from different sets of cutlery which differ quite widely in their shapes, it can happen that the items of cutlery which have been placed in the basket for cleaning can come into contact with sites on the supports which do not correspond to the deepest most suitable contact site for the draining away of the water droplets which have remained hanging on the item. In such conditions there will be persistent water spotting evident on the cleaned and dried cutlery. Furthermore, it has been found that, in the case of items of cutlery with a blade-shaped bearing surface (for example, knife blades), it is possible for water droplets to become lodged between the contact profile (for example, saw-teeth) of the cutlery support and the item of cutlery so that, after the cutlery items have been dried, water marks or spots will be left behind on said items. These spots or marks on the otherwise bright surface of the knife blades are often regarded as being unsightly and unhygienic.

The problem to be solved by the present invention is how to improve a cutlery-holding basket of the type initially referred to in such a manner that any arbitrary collection of items of cutlery from various different cutlery sets can be equally well loaded into the basket so that any undesirable accumulation of water droplets on said items can be effectually prevented.

The problem which has to be dealt with can be solved in accordance with the present invention.

Advantageous developments of the invention can be gleaned from the following description.

Because of the configuration of the cutlery-holding basket with supports having different profiles and/or different heights for the items of cutlery as well as the grouping together of the cutlery supports to take into consideration the dividing up of the cutlery-holding basket into separate areas to accommodate the most widely different items of cutlery, it is possible to achieve the optimal arrangement of the contact surfaces. In this connection, the number of the support and contact surfaces which allow for the most comprehensive point-shaped contacts is kept to a minimum. For example, for the knife supports, there is provision of only blade-shaped smooth supports which are higher than the saw-tooth-shaped supports which are preferably disposed between them and which are used to support the small and large spoons. This provides the possibility that, with appropriate shaping of the items of cutlery, the supports for the spoons can reach right across underneath the knives in order to provide additional conduction of water droplets which may be hanging down from the knives at various different locations. Along with this, the cutlery supports provided in accordance with the present invention take over the function of conducting water away from the sites which are critical for the formation of water droplets. The heights of the supports for the recesses to accommodate the items of cutlery can additionally be selected in such a manner that there is a slight slope of the individual items of cutlery towards the bottom of the basket. This slope facilitates the draining away of the water right down to the contact sites of the supports which serve to conduct the water away.

Figure 3:
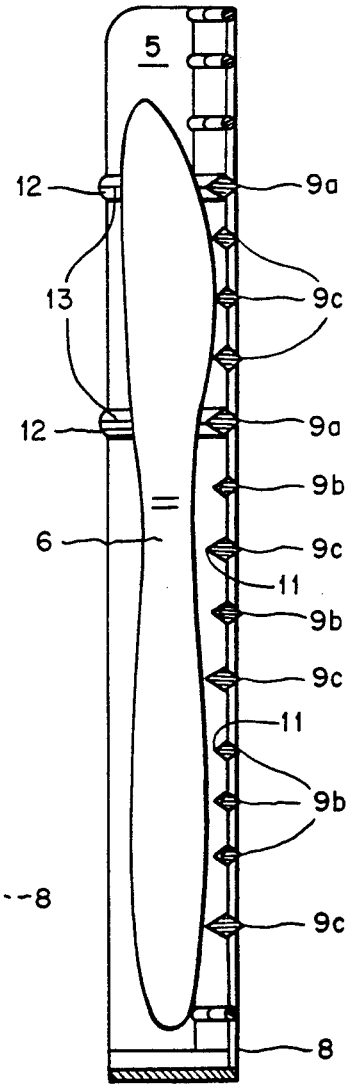
Figure 2:
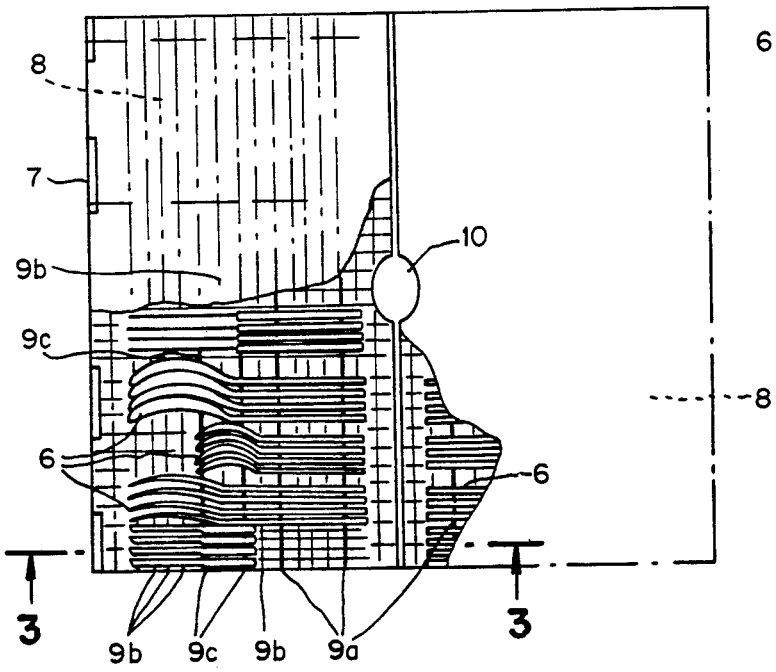

The following description will serve to elucidate the object of the present invention of which an example of embodiment is illustrated in the accompanying drawings in which :

FIG. 1 is a perspective view of a dish-washing machine with the front door open and the cutlery-holding basket partly pulled out from the washing space, FIG. 2 is a plan of the basket showing some items of cutlery, FIG. 3 is a longitudinal section through the basket along the line III—III shown in FIG. 2.

The dish-washing machine 1 depicted in FIG. 1 serves for the cleaning, rinsing and drying of crockery and cutlery and consists of a washing space 2 accommodating two pull-out crockery baskets (3, 4). The crockery baskets (3, 4) are furnished with spray devices which are not depicted but which spray the crockery packed into the baskets both from above and below with the liquid used for washing and rinsing.

A separate cutlery-holding basket designated as 5 which can also be pulled out from the washing space (2) serves for the accommodation of the items of cutlery such as spoons, forks, knives, ladles and so forth, which have been sorted into large and small sizes. The items of cutlery (6) are laid down lengthwise alongside each other in the cutlery-holding basket (5) without coming into contact with one another.

The cutlery-holding basket (5) shown on plan in FIG. 2 consists of a flat basket-like framework (7) with/without runner-wheels or the like within the plan dimensions of a crockery basket. Inside the framework (7) there is/are one or several flat basket inserts (8) which are preferably interchangeable. The selected form of embodiment corresponding to FIG. 2 has two basket inserts (8) in the form of sieves or strainers which form the bottom of the cutlery-holding basket and said inserts are provided with receptacles (9) for the isolated accommodation of the individual items of cutlery (6). A central opening (10) is left free between the two basket inserts (8) in the cutlery-holding basket (5). On the one hand, this opening facilitates the manual removal of the basket inserts from the cutlery-holding basket and, on the other hand, it provides a passage for the washing and rinsing liquid which is sprayed down from the top of the washing space for supplying the intermediate spray arm. The opening (10) also aids in the central positioning of the two basket inserts (8) and is correspondingly fabricated with suitable guides.

The receptacles (9) [FIG. 2 and 3] consist of holders (9*a*) which are preferably rigidly moulded onto the base of the basket (5) for the items of cutlery (6) and of separate supports (9*b*) and (9*c*). The holders (9*a*) for the items of cutlery are configured as toothed strips, the supports (9*b*) preferably have a saw-tooth-shaped bearing surface (11) and the supports (9*c*) are smooth-profiled strips with blade-shaped bearing edges (11) for the items of cutlery. The holders (9*a*) and the supports (9*b*, 9*c*) for the items of cutlery are disposed parallel to one another in the cutlery-holding basket (5) or the basket inserts (8) as the case may be. As a general rule, with this type of design, the holders (9*a*) are intended to accommodate the handles of the items of cutlery and the supports (9*b*, 9*c*) are for the blades of the knives and bowls of the spoons. However, an exception to this rule as depicted for the knife support in FIG. 3 is often desirable and advantageous because the shapes of the knives differ greatly from the shapes of all the other items of cutlery. As shown in FIG. 3, the handles of the knives only rest on the supports (9*c*), whereas the knife blades receive additional lateral support in the accommodation openings (12) in the holders (9*a*) for the items of cutlery. In this situation, the bearing surfaces designated as (13) of the holders (9*a*) are designed to provide smaller, approximately pointed contact surfaces, similar to the blade-like supports (9*c*), or else they are moulded on as blade- or knurl-like projections.

The different knife supports (9*b*, 9*c*), in adaptation to the different items- of cutlery and/or to their various shapes, are divided up into separate cutlery support groups in the cutlery-holding basket (5) so that practically every spoon and every fork and every knife is allocated predetermined cutlery holders (9) for their accommodation. The individual cutlery supports (9*b*, 9*c*) as well as the cutlery holders (9*a*), if so required, can all additionally have different support heights, by which means it is possible to minimize the number of contact sites when the items of cutlery are loaded into the basket. Depending upon the particular design, one or several similar cutlery supports (9*b*) and/or (9*c*) can form one group of cutlery supports, under which conditions the different supports are preferably arranged in alternating sequence in the cutlery-holding basket (5).

In accordance with the particular selected arrangement (FIG. 2 and 3) of the cutlery holders (9*a*) in the cutlery-holding basket (5), there are two cutlery holders (9*a*) with three blade-shaped, smooth cutlery supports (9*c*) between the holders and adjacent to them, there is provided, twice in alternating sequence, a cutlery support (9*b*) with saw-tooth-shaped bearing surfaces (11) and a blade-shaped cutlery support (9*c*). Adjoining these there is a group of cutlery supports consisting of three saw-tooth-shaped cutlery supports (9*b*), and this is terminated by a blade-shaped cutlery support (9*c*) with a smooth support surface. The cutlery supports (9*c*) which are provided between the cutlery holders (9*a*) and which likewise form a support group for the knives, serve as supports for the knife blades where the knives are supported laterally on their blades in the cutlery holders (9*a*) by way of the bearing surfaces (13). The additional three blade-shaped cutlery supports (9*c*) to the left of the cutlery holder (9*a*) are allocated as a cutlery support group to the handles of the knives. These cutlery supports (9*c*) are each of such a height that they are located above the height of the saw-tooth-shaped cutlery supports (9*b*). The cutlery supports (9*b*) which are therefore at a lower level can be used additionally, if so required, as means for draining away the water droplets from the items of cutlery (for example, knives) which bridge over them, but without actually coming into contact with them.

Between the two last cutlery supports (9*c*) for the knives there are three cutlery supports (9*b*) for supporting the bowls of large spoons and these likewise form a cutlery support group. The handles of the spoons are supported laterally and from below by the corresponding appropriate contact and bearing surfaces (13) of the cutlery holder (9*a*). The same applies for the supporting of smaller spoons, the bowls of which, by way of contrast, only come into contact with saw-tooth-shaped cutlery supports (9*b*) which form a group between two blade-shaped cutlery supports (9*c*). The three cutlery supports (9*b*) which are grouped together can be used simultaneously for accommodating forks.

In addition, the support height of the individual cutlery holders and the cutlery supports can be selected in such a way that items of cutlery (6) are disposed on a slight slope in relation to the bottom of the cutlery-holding basket. This has a supportive effect in the conducting away of the water droplets right down to the support points of the individual items of cutlery (6). Instead of saw-tooth-shaped cutlery supports, it is possible to use support strips with a wave-shaped profile. Saw-tooth-shaped cutlery supports (9*b*), especially when they are provided in groups, are particularly advantageous for the loading and holding in position of curved items of cutlery such as forks and spoons. The toothed profile of the cutlery supports (9*b*) prevents the tipping-over of the sorted items of cutlery (6). Should the need arise, the blade-shaped cutlery supports (9*c*) which have greater support height can also serve as additional supports.

We claim:

1. In a cutlery-holding basket for a dish-washing machine, in which the items of cutlery which are to be washed and dried can be individually laid down lengthwise alongside one another in cutlery holders at small distances apart, where the cutlery holders are constructed to hold separate items of cutlery as well as providing supports with appropriate bearing surfaces for the items of cutlery, the improvement which comprises the separate cutlery supports for the knives, forks and spoons resting on their sides are provided with differently profiled support surfaces and/or different support surfaces;

wherein the cutlery supports are arranged in the cutlery-holding basket so that they form groups;

wherein the separate cutlery supports are arranged in alternating sequence in the cutlery-holding basket so that one or several similar cutlery supports can form one group of cutlery supports; and wherein the cutlery supports of the one cutlery support of a first group have a sawtooth-shaped bearing surface and the cutlery supports of a second group are smooth profiled strips with blade-shaped bearing edges for the knives, forks and spoons, in which case the blade-shaped smooth supports of the second group have the greater height than the cutlery support of the first group.

2. The cutlery-holding basket according to claim 1, wherein the improvement comprises the heights of the cutlery supports are different from those of the heights of the cutlery holders which are provided with the moulded-on blade or knurl-like projections as supports for the knives, forks and spoons.

3. The cutlery-holding basket according to claim 2, wherein the improvement comprises the heights of the supports are selected in such a manner that there is a slight slope of the individual knives, forks and spoons toward the bottom of the basket.

4. The cutlery-holding basket according to claim 2, wherein the improvement comprises in each case, between two cutlery holders there is at least one similar cutlery support.

5. The cutlery-holding basket according to claim 4, wherein the improvement comprises receptacles for items of cutlery in the cutlery-holding basket, the arrangement of the receptacles for the items of cutlery in the cutlery-holding basket is selected in such a manner as to allocate to each item of cutlery two cutlery holders with three blade-shaped, smooth cutlery supports between the holders and adjacent to them, there is provided, twice in alternating sequence, a cutlery support with sawtooth-shaped bearing surfaces and a blade-shaped, smooth cutlery support adjoining these there is a group of cutlery supports consisting of three sawtooth-shaped cutlery supports, and this is terminated by a blade-shaped cutlery support with a smooth support surface.

* * * * *